United States Patent [19]

Edmonds

[11] Patent Number: 4,513,664

[45] Date of Patent: Apr. 30, 1985

[54] IMPACT SWITCH FOR GUIDED PROJECTILES

[75] Inventor: David A. Edmonds, King George, Va.

[73] Assignee: The United States of America as represented by the Secretary of the Navy, Washington, D.C.

[21] Appl. No.: 494,156

[22] Filed: May 13, 1983

[51] Int. Cl.[3] ..... F42C 19/06

[52] U.S. Cl. ..... 102/216

[58] Field of Search ..... 102/216, 262; 200/61.45 R

[56] References Cited

U.S. PATENT DOCUMENTS

| | | | |
|---|---|---|---|
| 3,158,705 | 11/1964 | Bliss | 102/216 |
| 3,453,406 | 7/1969 | Pope | 102/262 |
| 3,667,393 | 6/1972 | Aronsson et al. | 102/216 |
| 3,769,911 | 11/1973 | Folkins | 102/216 |
| 3,842,222 | 10/1974 | Hogland | 200/61.44 |
| 3,894,490 | 7/1975 | Zacharin | 102/216 |
| 4,178,855 | 12/1979 | McVay et al. | 102/262 |

FOREIGN PATENT DOCUMENTS

| | | | |
|---|---|---|---|
| 2541830 | 1/1979 | Fed. Rep. of Germany | 102/216 |
| 1514249 | 1/1968 | France | 102/216 |

*Primary Examiner*—Charles T. Jordan

*Attorney, Agent, or Firm*—Robert F. Beers; Kenneth E. Walden

[57] ABSTRACT

An annular impact switch for activating the electrical firing circuit of a guided projectile. An annular base member formed from thermoplastic is fixedly secured within the nose of the guided projectile. An annular crushable member formed from thermoplastic is mated to the annular base member. Both members are selectively coated with a multi-layered electrically-conductive film; a spatial separation between the electrically-conductive films coating the annular base member and the annular crushable member maintains the electrical firing circuit in an open state. Upon impact with a target the annular crushable member is deformed into contact with the annular base member such that their respective electrically-conductive films are in electrical contact to close the electrical firing circuit of the projectile, detonating the projectile explosive.

20 Claims, 8 Drawing Figures

IMPACT SWITCH FOR GUIDED PROJECTILES

BACKGROUND OF THE INVENTION

The present invention relates to impact switches, and more particularly, to an annular impact switch for use in guided projectiles.

Guided projectiles utilize active or passive sensor systems, such as radar, laser, semi-active laser, or infrared, to detect a target and furnish guidance signals to home the projectile to impact with the target. These sensor systems require that a centerline segment of the nose of the guided projectile be transparent to a particular electromagnetic radiation wave band transmitted by, or reflected from, the target. In addition, these sensor systems require an electromagnetic radiation receptor disposed along the centerline of the guided projectile behind the transparent window of the nose to intercept the radiation transmitted by, or reflected from, the target. These requirements of sensor systems for a guided projectile seeker impose certain design constraints, i.e., a certain volume along the centerline at the nose of the guided projectile must be allocated to the sensor system. A guided projectile seeker uses a gyroscope with a rotating rotor magnet as a stabilizing mechanism as part of the guidance system. An impact switch in close proximity to the gyroscope must be designed so that it will not affect the functioning of the gyroscope. The design of an impact switch must also take into account the inertial effects acting upon the switch when the guided projectile is fired; acceleration forces of approximately 8,000 G's act on the projectile momentarily during the firing sequence. Finally, to achieve maximum warhead performance for a guided projectile having a shaped explosive charge, the explosive train of the projectile must be initiated within a very short period of time after the nose of the projectile impacts the target. An impact switch, by initiating near instantaneous detonation of the shaped explosive charge of the projectile upon impact with the target, causes the high-energy jet generated by the shaped explosive charge to be focused on the surface of the target to ensure maximum target penetration, and consequently, maximum target damage.

Typical impact switches, such as those disclosed in U.S. Pat. Nos. 3,842,222 to K. Hogland, 3,453,406 to K. Pope, and 3,158,705 to R. Bliss, utilize the force resulting from impact with an external object to deform a first element into contact with a second element to electrically activate a response circuit. The major limitation of these devices is that they are designed to function so that the impact force must be transmitted nearly perpendicularly from the point of impact to deform the first element. Due to the design constraints of guided projectiles, these types of impact switches would have to be positioned a significant distance rearward from the nose of the projectile if the impact force is to be transmitted approximately perpendicularly to the first element. Positioning the impact switch at a greater distance from the point of impact would decrease the performance of the warhead by increasing the initiation time of the explosive train due to the greater distance and intervening elements that the impact force would be transmitted through before acting to deform the first element into contact with the second element. The effect of this would be that the high-energy jet of the shaped explosive charge of a seeker guided projectile would not be focused on the surface of the target, but rather at a point behind the surface of the target which would attenuate the penetration capability of the projectile. Disposing these types of switches on the inner periphery of the nose of the projectile would result in added expense due to the number of switches required and the necessity of redundant hookups to the firing circuit of the projectile. In addition, the transmittal of the impact force at the periphery of the projectile nose may be other than approximately perpendicular to the first element which may result in a higher frequency of impact switch malfunction due to failure to deform the first element into contact with the second element. U.S. Pat. No. 3,158,705 also discloses an inertial switch for closing the firing circuit of a projectile when the projectile impacts the target at a graze angle. In addition to being limited in the same manner as impact switches, another disadvantage of inertial switches is the possibility of inadvertent activation of the firing circuit due to the inertial effects on the circuit closing elements of the inertial switch as the projectile experiences the high acceleration forces generated as the projectile is fired.

SUMMARY OF THE INVENTION

The present invention overcomes the disadvantages and limitations of the prior art by use of an annular impact switch peripherally disposed about the sensor system in the nose of a guided projectile. An annular base member formed of a non-conducting, low density material is mounted in the nose of the projectile, and an annular crushable member formed of the same or a similar low density material is mounted in concentric proximity to, and forward of, the base member. Each member is coated with an electrically-conductive film, and each film is discontinuous at at least one location to prevent eddy currents from being induced therein by the rotating rotor magnet of the gyroscope causing drag loading thereon. Upon projectile impact with the target at an angle of incidence in the range of 0° to approximately 70°, the force of impact deforms the crushable member into contact with the base member so that their respective electrically-conductive films are in contact to close the electrical firing circuit thereby generating an electric current which initiates detonation of the projectile explosive.

An object of this invention is to provide an annular impact switch that is compatible for use with a guided projectile.

Another object of this invention is to provide an annular impact switch to close the electrical firing circuit of a guided projectile upon impacting a target at an angle of incidence in the range of 0° to approximately 70°.

A further object of this invention is to provide an annular impact switch that is unresponsive to the high acceleration forces generated when the projectile is fired.

A still further object of this invention is to provide an annular impact switch which will have no adverse effects on the functioning of the gyroscope of a guided projectile.

A final object of this invention is to provide an annular impact switch of simple construction, low fabrication cost and high reliability of operation.

DESCRIPTION OF THE PREFERRED EMBODIMENT

Figure 1:
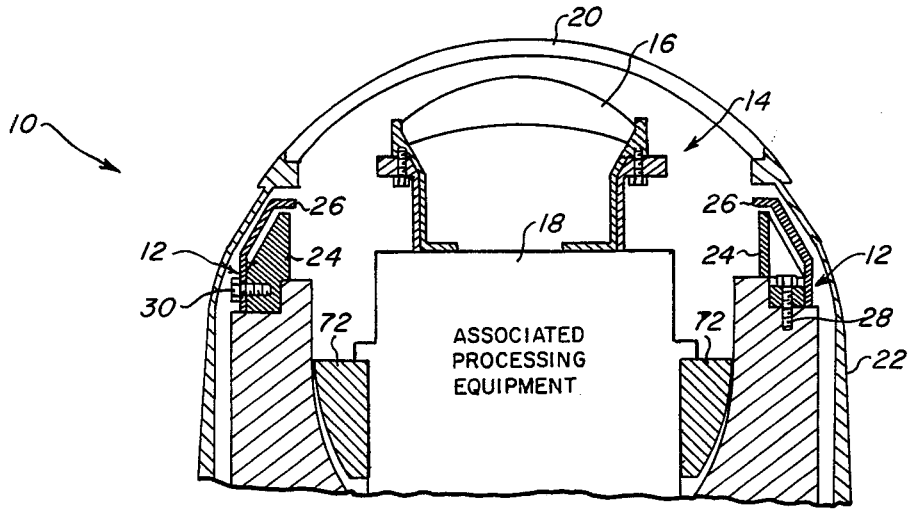
FIG. 1 is a cross-sectional view of the nose section of a guided projectile showing, inter alia, the annular impact switch including annular base member and annular crushable member portions mounted therein.

Referring to FIG. 1, a guided projectile 10 is shown with a two-element annular impact switch 12 mounted therein. By way of general example, the guided projectile 10 is shown as employing a passive infrared radiation sensor system 14 as the seeker. The IR sensor system 14 is comprised of a lens 16 for focusing the infrared radiation emitted by the target and associated processing equipment 18 which is common to infrared radiation detection systems known in the prior art. The nose of the guided projectile 10 has a transparent window 20 contiguous with the projectile casing 22 which passes infrared radiation in the wave bands of interest. The seeker (sensor system 14) mounted in the nose of the guided projectile 10 could be any of the conventional sensor systems known in the prior art, such as radar, laser or infrared. The two-element annular impact switch 12 is comprised of an annular base member 24 and an annular crushable member 26. The annular base member 24 is fixedly secured in the nose of the guided projectile 10 by four securing screws 28. The annular crushable member is mated to, but spaced apart from, the annular base member 24 by four mating screws 30.

Figure 2:
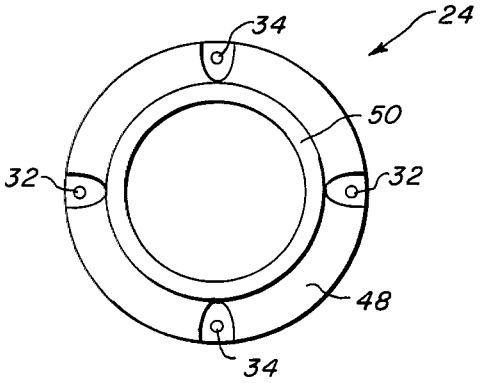
FIG. 2 shows an end view of the annular base member of FIG. 1.

As shown in FIG. 2 the annular base member 24 includes two pairs of securing bores 32, 34 equidistantly spaced around the base member 24. The four securing screws 28 are inserted through respective bores of the two pairs of securing bores 32, 34 to fixedly secure the base member 24 in the nose of the guided projectile 10. The securing screws 28 in securing bore pair 32 form an electrical interconnection between a first electrically-conductive film 36 (more fully described below) coating the annular base member 24 and a first lead-in means of the electrical firing circuit (not illustrated). The securing screws 28 in securing bore pair 34 form an electrical interconnection between a third electrically-conductive film 40 (more fully described below) coating the annular crushable member 26 and a second lead-in means of the electrical firing circuit (not illustrated). A second electrically-conductive film 38 (more fully described below) coating the annular base member 24 provides an intermediate electrical connection between the securing screws 28 in securing bore pair 34 and the third electrically-conductive film 40. The second electrically-conductive film 38 is physically discontinuous from the first electrically-conductive film 36. Electrical firing circuits for projectile warheads are disclosed in the prior art and any of the known configurations may be employed in conjunction with the present invention herein described. The two securing screws 28 in securing bore pair 32 provide alternate electrical pathways to the first lead-in means of the electrical firing circuit (not illustrated). Similarly, the two securing screws 28 in securing bore pair 34 provide alternate electrical pathways to the second lead-in means of the electrical firing circuit (not illustrated). This inherent redundancy in activating the electrical firing circuit of the guided projectile 10 increases the reliability of the two-element annular impact switch 12.

Figure 3:
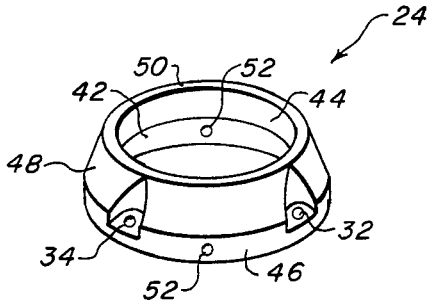
FIG. 3 shows a perspective view of the annular base member of FIG. 2.

The configuration of the annular base member is shown in perspective in FIG. 3. The inner surface is a stepped cylinder having a lower shoulder 42 of slightly larger diameter than an upper shoulder 44 for positioning the annular base member 24 so that it may be fixedly secured within the guided projectile 10. The outer surface of the annular base member 24 has a cylindrical base 46, a contact surface 48 which is canted inwardly with respect to the cylindrical base 46 and an upper contact ridge 50. Four base member mating bores 52 are positioned equidistantly around the cylindrical base 46 for mating the annular crushable member 26 to the annular base member 24.

Figure 4:
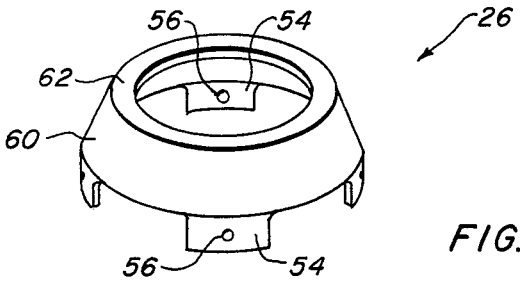
FIG. 4 shows a perspective view of the annular crushable member of FIG. 1.

The annular crushable member 26 is shown in perspective in FIG. 4. The lower segment is comprised of four equidistantly spaced tabs 54. Each tab 54 has a crushable member mating bore 56 for mating the annular crushable member 26 to the annular base member 24. Mating screws 30 are inserted through the mating bores 56 into the base member mating bores 52 to mate the annular crushable member 26 to the annular base member 24. The annular crushable member 26 has an upper crushable surface 60 which is canted with respect to the tabs 54 and an upper deformable ridge 62. With the annular crushable member 26 mated to the annular base member 24 the upper crushable surface 60 of the annular crushable member 26 is parallel to the contact surface 48 of the annular base member 24 and separated therefrom by approximately 0.050 inch. Similarly, the upper deformable ridge 62 of the annular crushable member 26 is parallel to the upper contact ridge 50 of the annular base member 24 and separated therefrom by approximately 0.050 inch.

Figure 5:
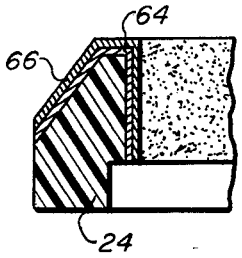
FIG. 5 is a cross-sectional view taken along line 5—5 of FIG. 7 illustrating the electrically-conductive film which coats the annular base member of FIG. 3.
Figure 6:
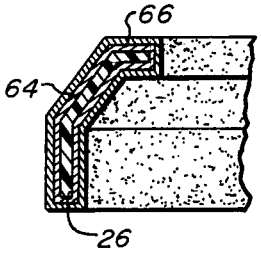
FIG. 6 is a cross-sectional view taken along line 6—6 of FIG. 8 illustrating the electrically-conductive film which coats the annular crushable member of FIG. 4.

The annular base member 24 and the annular crushable member 26 are formed by injection molding a platable grade thermoplastic having at least two defined characteristics. First, the density of the thermoplastic must be relatively low to reduce inertial loading on the two-element annular impact switch 12 so that inadvertent activation of the electrical firing circuit of the projectile 10 by deformation of the annular crushable member 26 and its third electrically-conductive film 40 into electrical contact with the annular base member 24 and its first electrically-conductive film 36 due to the approximately 8,000 G's experienced during projectile firing is prevented. Second, the thermoplastic must be a good insulating material but it must be conducive to chemical treatment such that an electrically-conductive film can be electroplated on the surface of the thermoplastic. For the preferred embodiment of the present invention, acrylonitrile butadiene styrene (ABS) was selected as the platable grade thermoplastic. ABS is a relatively low density material, having a density of approximately 0.04 pounds per cubic inch, less than half the 0.097 pounds per cubic inch density of an average aluminum alloy. ABS is a good insulating material but can be chemically treated by methods known in the prior art so that a metallic material may be chemically bonded to its surface. This metallic layer then functions as the anode in an electroplating process so that a conducting metal may be electroplated on the chemically-bonded metallic layer. For the invention herein described, the annular base member 24 and the annular crushable member 26 were formed from ABS, and their surfaces were then chemically treated so that a thin, metallic layer of electroless nickel was chemically bonded to selected surface areas of the ABS. In the alternative, electroless copper could be substituted for electroless nickel. The annular base member 24 and the annular crushable member 26, after being selectively coated with electroless nickel, are then subjected to an electroplating process so that a thin layer of gold is electroplated onto the electroless nickel. As shown in FIGS. 5 and 6, the first electrically-conductive film 36 coating the annular base member 24 and the third electrically-conductive film 40 coating the annular crushable member 26 are multi-layered. The inner layer 64 is electroless nickel chemically bonded to selected areas of the ABS infrastructure. The outer layer 66 is an electrically-conductive layer of gold electroplated onto the inner layer 64 of electroless nickel. The second electrically-conductive film 38 (not illustrated in cross-section) is also multi-layered in a similar manner.

Figure 7:
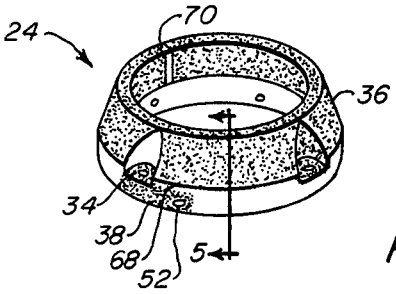
FIG. 7 shows the pattern of the electrically-conductive film coating the annular base member of FIG. 3.

As shown in FIG. 7, the upper shoulder 44, the contact surface 48 and the upper contact ridge 50 of the annular base member 24 are coated with the first electrically-conductive film 36. The film 36 provides the electrical interconnection to the first lead-in means of the electrical firing circuit (not illustrated) by means of the securing screws 28 in intimate contact with the first electrically-conductive film 36 electroplated around the securing bore pair 32. The second electrically-conductive film 38 coats the securing bore pair 34 and a short section of the cylinderical base 46 so as to encompass the base member mating bores 52 in close proximity to the securing bore pair 34. A thin, insulating gap 68 is left uncoated so that there is an electrical discontinuity between the first electrically-conductive film 36 and the second electrically-conductive film 38. The securing screws 28 in securing bore pair 34 form an electrical interconnection to the second lead-in means of the electrical firing circuit (not illustrated) by being in intimate contact with the second electrically-conductive film 38 contiguous with the securing bore pair 34. A base member eddy current gap 70 of approximately 0.10 inch is left uncoated on the upper shoulder 44, the contact surface 48 and the upper contact ridge 50 of the annular base member 24 so that the first electrically-conductive film 36 is discontinuous, i.e., the base member eddy current gap 70 has an electrical resistance of approximately 100 megohms. This discontinuity prevents eddy currents from being induced in the first electrically-conductive film 36 by the gyroscope rotor magnet 72 and causing drag loading thereon.

Figure 8:
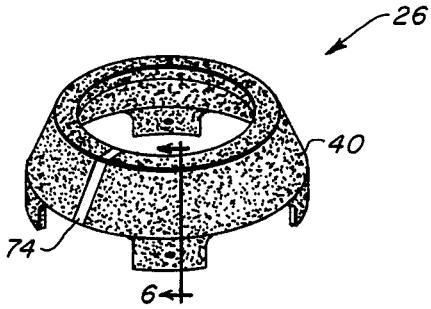
FIG. 8 shows the pattern of the electrically-conductive film coating the annular crushable member of FIG. 4.

As shown in FIG. 8 the entire annular crushable member 26 is coated with the third electrically-conductive film 40 except for a crushable member eddy current gap 74 of approximately 0.10 inch circumscribing the annular crushable member 26. The crushable member eddy current gap 74 has an electrical resistance of approximately 100 megohms. Therefore, the third electrically-conductive film 40 is electrically discontinuous so that eddy currents are not induced therein by the gyroscope rotor magnet 72. The third electrically-conductive film 40 coating the inner surface of tabs 54 is in electrical contact with the second electrically-conductive film 38 adjacent to the securing bore pair 34. The first and second electrically-conductive films 36, 38 coating the annular base member 24 and the third electrically-conductive film 40 coating the annular crushable member 26 each have thicknesses of approximately 0.0020 inch (FIGS. 5 and 6) so that the outer layer 66 of gold has a resistance of approximately 0.0050 ohm between the securing bore pair 32 of the annular base member 24, and between any two tabs 54, spaced 180° apart, of the annular crushable member 26. The thickness of approximately 0.0020 inch of the first and third electrically-conductive films 36, 40 also reduces the possibility that eddy currents will be induced therein. The electrically-conductive films 36 and 38 and the electrically-conductive film 40 resist peeling, chipping and cracking over a temperature range of approximately −40° to approximately 75° C.

Prior to impacting a selected target, the electrical firing circuit of the guided projectile 10 is in an open state. The first electrically-conductive film 36 of the annular base member 24 is electrically connected to the first lead-in means of the electrical firing circuit (not illustrated). The third electrically conductive film 40 of the annular crushable member 26 is in electrical contact with the second electrically-conductive film 38 of the annular base member 24 which is electrically connected to the second lead-in means of the electrical firing circuit (not illustrated). A spacing of approximately 0.050 inch between the first electrically-conductive film 36 of the annular base member 24 and the third electrically-conductive film 40 of the annular crushable member 26 maintains the electrical firing circuit of the guided projectile 10 in the open state. Upon impact with the target the force of impact is transmitted through the transparent window 20 and/or the projectile casing 22 to deform the annular crushable member 26 and its third electrically-conductive film 40 into electrical contact with the first electrically-conductive film 36 of the annular base member 24 to close the electrical firing circuit of the guided projectile 10. The configuration of the two-element annular impact switch 12 is such that the force of impact is transmitted to activate the electrical firing circuit and detonate the explosive (not shown) of the projectile within 100 microseconds of impact. For impact with an angle of incidence of 0°, defined as the centerline of the projectile meeting the surface of the target at a right angle, the force of impact is transmitted to deform the upper deformable ridge 62 and its third electrically-conductive film 40 of the annular crushable member 26 into electrical contact with the first electrically-conductive film 36 coating the upper contact ridge 50 of the annular base member 24 to close the electrical firing circuit and detonate the explosive (not shown) of the guided projectile 10. For impacts where the angle of incidence is greater than 0° up to angles of incidence of 70°, the angle of incidence being defined as the angle formed by the centerline of the projectile with the surface plane of the target, the force of impact is transmitted to deform the upper crushable surface 60 and its third electrically-conductive film 40 of the annular crushable member 26 into electrical contact with the first electrically-conductive film 36 coating the contact surface 48 of the annular base member 24 to close the electrical firing circuit and detonate the explosive (not shown) of the guided projectile 10.

What is claimed and desired to be secured by Letters Patent of the United States is:

1. An impact switch for closing an electrical firing circuit of a guided projectile, comprising:

an annular base member formed of a non-metallic, non-conducting material fixedly secured in the forward end of the guided projectile;

an electrically-conductive film coating said annular base member over a substantial portion thereof with a portion of said film adapted for communication with the electrical firing circuit of said guided projectile;

said substantial portion of said film having an electrical discontinuity at at least one location on said annular base member to prevent eddy currents from being induced therein;

an annular crushable member formed of a non-metallic, non-conducting material mounted concentrically of, and in close proximity to, said annular base member; and an electrically-conductive film coating said annular crushable member over a substantial portion thereof with a portion of said film adapted for communication with the electrical firing circuit of said guided projectile;

said substantial portion of said film having an electrical discontinuity at one location on said annular crushable member to prevent eddy currents from being induced therein;

whereby upon impact of said guided projectile with a target at an angle of incidence from 0° to approximately 70° said annular crushable member coated with said electrically-conductive film will be deformed into contact at at least one point with said electrically-conductive film of said annular base member to close the firing circuit of said guided projectile generating an electric current which detonates an explosive in said guided projectile.

2. The invention as defined in claim 1 wherein:

said annular crushable member has a crushable surface canted inwardly whereby at impact with a target at an angle of incidence of greater than 0° to approximately 70° the force of impact will be transmitted substantially perpendicularly against said crushable surface to deform said crushable surface coated with said electrically-conductive film into electrical contact at at least one point on said electrically-conductive film of said annular base member.

3. The invention as defined in claim 1 wherein:

said non-metallic, non-conducting material has a low density to prevent the high acceleration forces generated when said guided projectile is fired from inadvertently deforming said annular crushable member coated with said electrically-conductive film into contact with said electrically-conductive film of said annular base member to prematurely close the electrical firing circuit of said guided projectile generating an electric current which prematurely detonates the explosive in said guided projectile.

4. The invention as defined in claim 3 wherein:

said non-metallic, non-conducting, low density material forming said annular base member is a platable grade thermoplastic adapted so that said electrically-conductive film may be deposited thereon.

5. The invention as defined in claim 3 wherein:

said non-metallic, non-conducting, low density material forming said annular crushable member is a platable grade thermoplastic adapted so that said electrically-conductive film may be deposited thereon.

6. The invention as defined in claim 4 wherein:

said platable grade thermoplastic is acrylonitrile butadiene styrene.

7. The invention as defined in claim 5 wherein:

said platable grade thermoplastic is acrylonitrile butadiene styrene.

8. The invention as defined in claim 1 wherein:

said electrically-conductive film coating said annular base member resists peeling, chipping and cracking over a temperature range of approximately −40° C. to approximately 75° C.

9. The invention as defined in claim 1 wherein:

said electrically-conductive film coating said annular crushable member resists peeling, chipping and cracking over a temperature range of approximately −40° C. to approximately 75° C.

10. The invention as defined in claim 1 wherein:

said electrically-conductive film of said annular base member comprises plural layers the outer of which is gold.

11. The invention as defined in claim 1 wherein:

said electrically-conductive film of said annular crushable member comprises plural layers the outer of which is gold.

12. The invention as defined in claim 10 wherein:

said gold layer of said electrically-conductive film coating said annular base member is applied by electroplating.

13. The invention as defined in claim 11 wherein:

said gold layer of said electrically-conductive film coating said annular crushable member is applied by electroplating.

14. The invention as defined in claim 10 wherein:

said plural layers of said electrically-conductive film have a total thickness not exceeding approximately 0.002 inch.

15. The invention as defined in claim 11 wherein:

said plural layers of said electrically-conductive film have a total thickness not exceeding approximately 0.002 inch.

16. The invention as defined in claim 1 wherein:

said electrical discontinuity at one location of said electrically-conductive film of said annular base member is a non-plated base member eddy current gap of approximately 0.1 inch.

17. The invention as defined in claim 1 wherein:

said electrical discontinuity of said electrically-conductive film of said annular crushable member is a non-plated crushable member eddy current gap of approximately 0.1 inch.

18. The invention as defined in claim 16 wherein:

said non-plated base member eddy current gap of approximately 0.1 inch of said electrically-conductive film has a minimum resistance of approximately 100 megohms.

19. The invention as defined in claim 17 wherein:

said non-plated crushable member eddy current gap of approximately 0.1 inch of said electrically-conductive film has a minimum resistance of approximately 100 megohms.

20. The invention as defined in claim 1 wherein:

said annular crushable member is in concentric proximity of approximately 0.050 inch to said annular base member.

* * * * *